US005176058A

United States Patent [19]

Skelly

[11] Patent Number: 5,176,058

[45] Date of Patent: Jan. 5, 1993

[54] WORKPIECE FIXTURE

[75] Inventor: Norman E. Skelly, Midland, Mich.

[73] Assignee: STRA-COL Inc., Midland, Mich.

[21] Appl. No.: 767,502

[22] Filed: Sep. 30, 1991

Related U.S. Application Data

[63] Continuation-in-part of Ser. No. 656,438, Feb. 19, 1991, abandoned.

[51] Int. Cl.[5] ..... B27B 27/02

[52] U.S. Cl. ..... 83/415; 83/437; 83/442; 83/452

[58] Field of Search ..... 83/442, 452, 412, 415, 83/418, 745, 444, 413, 437

[56] References Cited

U.S. PATENT DOCUMENTS

| | | | |
|---|---|---|---|
| 1,360,604 | 11/1920 | Wallace | 83/442 |
| 2,655,959 | 10/1953 | Krueger et al. | 83/415 |
| 4,002,329 | 1/1977 | Petroski | 83/437 |
| 4,077,292 | 3/1978 | Cole | 83/745 |
| 4,485,711 | 12/1984 | Schnell | 83/437 |
| 4,628,782 | 12/1986 | Park | 83/442 |

OTHER PUBLICATIONS

Wood Magazine, Sep. 1990, p. 16.

*Primary Examiner*—Frank T. Yost
*Assistant Examiner*—Allan M. Schrock
*Attorney, Agent, or Firm*—Learman & McCulloch

[57] ABSTRACT

A workpiece-holding fixture for use with a table saw to cut straight, parallel or tapered sides on a workpiece. The fixture comprises a channel-shaped body having clamps for removably securing a workpiece in the body, a shield supported by the body for overlying the saw blade, and retainers cooperable with the table saw fence for preventing interference between the fixture and the saw blade. A guide is provided for use in supporting successive workpieces to enable them to be uniformly tapered.

16 Claims, 3 Drawing Sheets

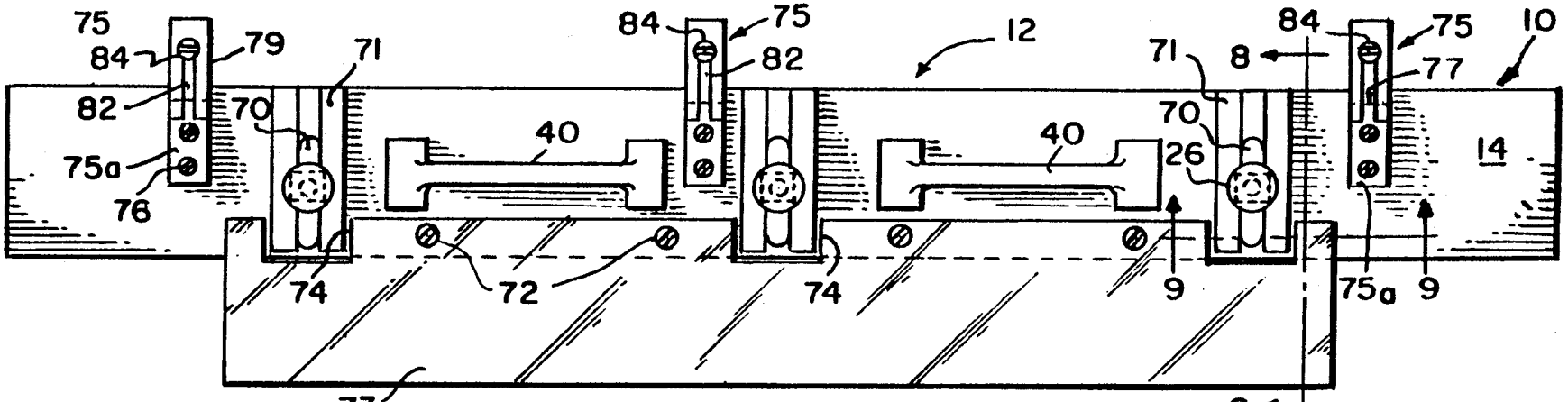
FIG.7
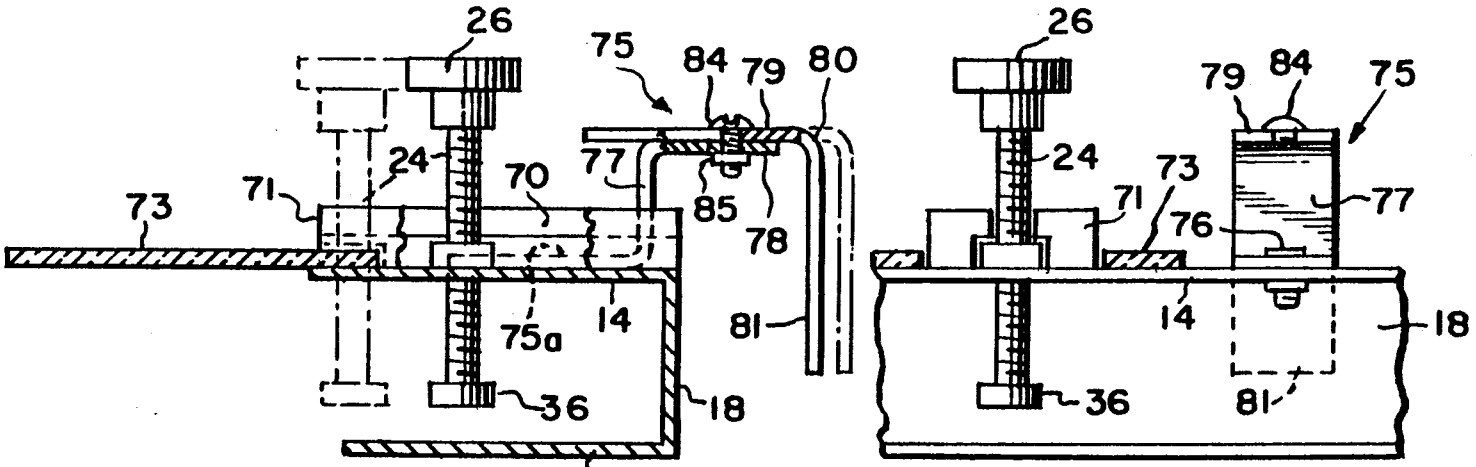
FIG.8
FIG.9

WORKPIECE FIXTURE

This application is a continuation-in-part of application Ser. No. 07/656,438 filed Feb. 19, 1991, now abandoned.

FIELD OF THE INVENTION

The present invention relates to a workpiece-holding fixture movable relative to a guide so as to transport the workpiece past a tool in a selected orientation thereto, and also to the combination of the workpiece-holding fixture with a table saw, band saw, table router, and the like having a table, a guide, and a tool.

BACKGROUND OF THE INVENTION

In preparing lumber for use in making furniture, cabinets, trim molding, and the like, rough-sawn boards cut from logs often must be processed to provide smooth, parallel top and bottom surfaces and straight, parallel, or tapered sides. Typically, rough-sawn boards are dried to render them dimensionally stable and then each board is planed to obtain the desired smooth, parallel top and bottom surfaces. Each board is then processed through a jointer to obtain the finished product having parallel or tapered sides.

Boards finished in this manner are commercially available and used in making the articles referred to above. However, during the manufacture of such articles the boards may be cut and otherwise worked in such a manner that a remaining unused portion of the board has sides that do not retain their original straightness and parallelism. Oftentimes, the woodworker wishes to use the remaining unused portion of the board in an application where the sides need to be straight and parallel or tapered. In this case, the woodworker may further process the board using a jointer, if one is available. Unfortunately, many home woodworkers do not possess or have ready access to a suitable jointer, which is an expensive piece of equipment.

As a result, there is a need for a device that the woodworker can use in lieu of a jointer to provide straight, parallel or tapered sides on a length of board having irregular sides and that can be purchased at a relatively low cost affordable by the typical home craftsman.

It is an object of the invention to satisfy this need by providing a fixture which is adapted to hold a workpiece (e.g., a length of board) and which is engageable with a guide (e.g., the rip fence of a table saw) as the fixture is moved relative to a tool (e.g., the saw blade of the table saw) so as to move the workpiece past the tool in a selected orientation thereto (e.g., to cut a straight, parallel, or tapered edge on the workpiece).

It is another object of the invention to provide such a fixture that is usable in combination with a table saw, band saw, table router, and the like which the wood worker may already possess or have ready access to.

Power woodworking tools present some danger to the users thereof, particularly in those instances in which the use of a tool is at variance with the normal use. Since the utilization of a table saw as a substitute for a jointer is at variance with the normal use of such saw, apparatus constructed in accordance with the invention includes means for safeguarding the user.

SUMMARY OF THE INVENTION

The present invention comprises a workpiece-holding fixture having a C-shaped body including (a) an upper flange, a lower flange underlying and spaced from the upper flange, and a side wall interconnecting the upper and lower flanges in a manner to define a workpiece-receiving channel, (b) a plurality of workpiece clamping members mounted on the upper flange for movement toward and away from the lower flange to clamp and unclamp the workpiece, and (c) at least one handle mounted on the fixture member for moving it and the workpiece clamped in the channel relative to the tool.

In one embodiment of the invention the clamping members are spaced apart along the length of the fixture. Preferably, each clamping member is threadedly mounted on the upper flange so that rotation of the clamping members effects movement thereof in a direction into or out of the channel. Quick release clamping members are thereby provided.

In another embodiment of the invention, one or more handles are carried by and spaced apart on the upper flange between the clamping members to facilitate movement of the workpiece relative to the saw blade and to protect the woodworker.

The invention also preferably includes a protective shield which overlies the saw blade when the fixture is in use and fence-engageable retainers for preventing engagement between the saw blade and the fixture.

A further feature of the invention comprises a workpiece guide which can be clamped in the fixture in a position to support successive workpieces in such position as to facilitate the cutting of tapered sides, while also clamping the workpiece in the fixture.

In accordance with an exemplary embodiment of the invention the fixture is adapted to accommodate a workpiece, such as a board, and is movable relative to the saw blade of a table saw, having a guide (rip) fence on the table oriented in a plane substantially parallel to the saw blade. The side wall of the fixture is adapted to engage the guide fence as the fixture is moved on the table, thereby enabling the saw to be moved through the workpiece clamped in the fixture. A first cut edge that is substantially parallel to the plane of the guide fence is thereby provided on the workpiece. The workpiece can then be removed from the fixture, positioned on the table with the first cut edge abutting the guide fence, and moved again relative to the saw to enable the blade to pass through the workpiece again to provide a second cut edge that will be parallel to the first cut edge. Preferably, the fixture has fence-engageable retainers to limit movement of the fixture toward the saw blade and a shield which overlies the saw blade to protect the user from the blade and chips.

The fixture is adapted to accommodate and secure a guide which can be used with successive workpieces to form tapered edges thereon.

DESCRIPTION OF THE DRAWINGS

FIG. 7 is a plan view of a modified embodiment of the fixture;

FIGS. 8 and 9 are enlarged sectional views taken on the lines 8—8 and 9—9, respectively, of FIG. 7;

DETAILED DESCRIPTION OF THE INVENTION

Figure 1:
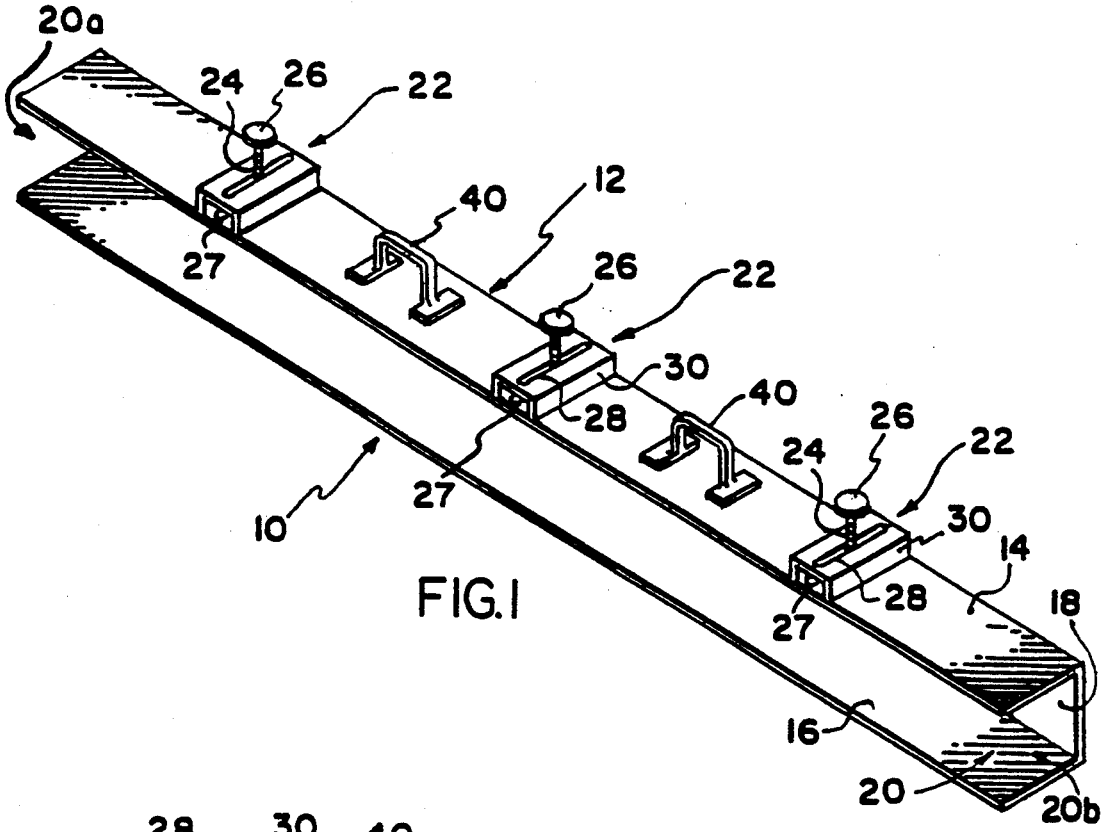
FIG. 1 is a perspective view of a fixture constructed in accordance with one embodiment of the invention.
Figure 2:
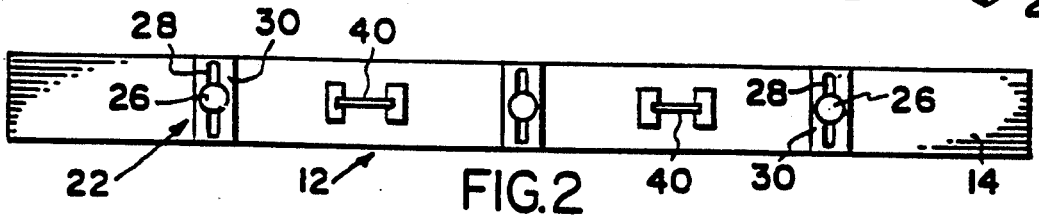
FIG. 2 plan view of the fixture of FIG. 1.
Figure 3:
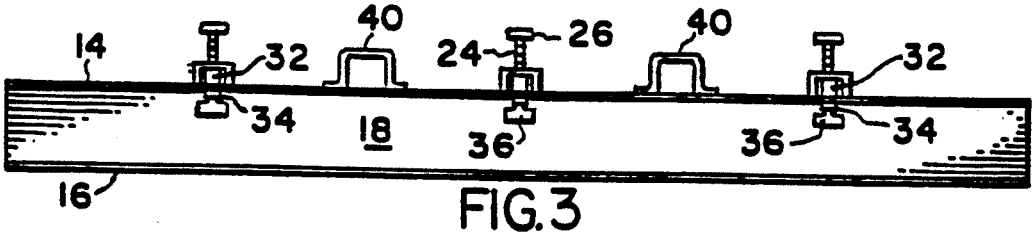
FIG. 3 is a side elevational view of the fixture of FIG. 1.

FIGS. 1-4 illustrate a workpiece fixture 10 having an elongated, C-shaped body 12 provided with an upper horizontal flange 14, a lower horizontal flange 16 underlying and parallel to the flange 14, and an upstanding vertical side wall 18 interconnecting the flanges 14, 16 to define an elongated workpiece-receiving channel 20. The body 12 typically comprises a one-piece, extruded aluminum member (e.g., ⅛ inch thick aluminum stock), although the flanges 14, 16 and the side wall 18 may comprise separate components mechanically or metallurgically fastened together.

In the disclosed embodiment the body 12 is of sufficient length to accommodate an elongated workpiece W, e.g., a board, having a length greater or less than that of the body. The channel 20 includes open ends 20*a*, 20*b* to accommodate such a workpiece. The upper and lower flanges are about 4 inches wide and the side wall is about 4 inches in height. Boards having wide variations in width can be accommodated in this embodiment so that an exposed lateral portion WP (FIG. 4) of the workpiece extends through the open side 20*a* of the channel 20 for cutting.

A plurality (three shown) of quick-release clamping members 22 are mounted in spaced apart relation along the upper flange 14. Each clamping member 22 includes a threaded shaft 24 having a manual turning knob 26 on the upper end thereof. The threaded shaft 24 extends vertically through a transversely elongated slot 27 in the upper flange 14 and a similar slot 28 in a clamp holder or bracket 30 and through a internally threaded clamp holder nut 32 movably positioned atop the upper flange 14. The lower end of the shaft 24 is threadedly received in a jam nut 34 below the flange 14 in the channel 20. The bracket 30 is fixed to the upper flange 14 by suitable fasteners (not shown), welding, or the like. The clamp holder nut 32 is trapped between the bracket 30 and the flange 14 as shown and is movable therebetween along the length of the slot 28. The jam nut 34 is internally threaded to receive the lower threaded end of the shaft 24. A clamp pad 36, engageable with a workpiece W, is mounted on the underside of the jam nut 34 by a swivel joint.

The clamping members 22 are movable toward and away from the channel 20 to clamp and unclamp the workpiece W as will be explained below. The vertical distance or clearance D between the bottom of the clamp pads 36 and the lower flange 16 is sufficient to accommodate a range of workpiece thicknesses that are likely to be encountered in use. For example, in the exemplary embodiment described above, a vertical clearance D of about two inches has been provided.

The clamping members 22 are also movable laterally in the channel 20 as permitted by the slots 27 in the upper flange 14 and the slots 28 in the brackets 30 to accommodate boards having different widths and also to clamp a length of board at a selected angle in the channel 20 for purposes to be explained below.

A plurality (two shown) of handles 40 are fixed atop the upper flange 14 between the clamping members 22 as shown in FIGS. 1-. The handles 40 may be fastened to the upper flange 14 by suitable fasteners (not shown), welding, or the like. The handles 40 are adapted to be gripped manually by the woodworker during cutting of the workpiece W to control the movement of the fixture and the workpiece.

In accordance with the invention, the fixture 12 is adapted to be used in combination with a conventional table saw, band saw, table router, and similar woodworking apparatus having a flat top table, a cutting tool (e.g., a circular or other saw blade or router blade) cooperatively disposed relative to the table, and a guide, such as a rip fence, mounted on or cooperatively disposed relative to the table so a to guide movement of the workpiece relative t the cutting tool.

Figure 5:
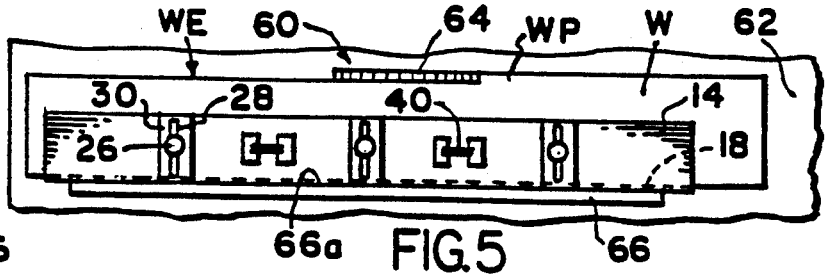
FIG. 5 is a fragmentary plan view of a table saw and fence having the fixture of FIG. 1 positioned on the table and abutting the fence for providing on a workpiece a straight edge surface parallel with the fence.

FIG. 5 illustrates an exemplary combination of the fixture 10 and a conventional table saw 60 having a table or platform 62 for supporting the fixture 12, a rotatable circular saw blade 64 driven by a motor (not shown), and an elongated rip fence 66 for guiding the fixture 10 relative to the blade 64 during ripping of the board (i.e., cutting along the length of the board). The fence 66 includes a smooth guide surface 66*a* facing the circular saw blade 64 and located in a vertical plane P1 that is substantially parallel to the plane P2 defined by the circular saw blade 64. The fence 66 is releasably mounted in known manner on the table 62 so that its lateral position relative to the saw blade 64 can be adjusted as needed to permit cutting of different width boards.

Figure 4:
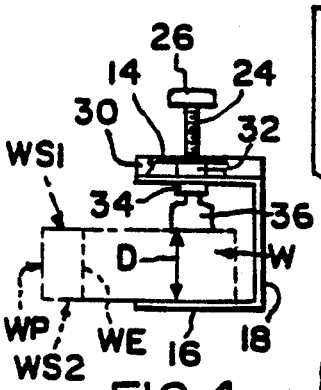
FIG. 4 is an end elevational view of the fixture of FIG. 1 with a length of board (shown in phantom) clamped therein.

In use, the workpiece W is positioned in the channel 20 between the upper and lower flanges 14, 16 as shown in FIG. 4. The length of the board is aligned with the longitudinal axis of the channel 20 with the upper and lower sides WS1, WS2 of the workpiece facing the respective upper and lower flanges 14, 16. The board length does not have to be aligned exactly parallel with the channel axis since the parallelism between the saw blade 64 and the rip fence 66 establishes the desired orientation of the cut surface to be imparted to the workpiece. The workpiece W is positioned so that the exposed portion WP thereof extends beyond the open side of the channel 20 for cutting by the saw blade 64. The clamping members 22 are moved toward the upper side WS1 of the board by turning the knobs 26 until the clamping pads 36 engage the upper side WS1 in clamping engagement therewith to clamp the board firmly in the channel 20 against the lower flange 16.

The fixture 10 having the workpiece W clamped therein is then placed on the table 62 with the side wall 18 snugly abutting the surface 66*a* of the rip fence 66. The handles 40 may be used to hold the fixture firmly against the fence and to move the fixture and the workpiece along the rip fence 66 with the lower flange 16 sliding on the table 62 to enable the saw blade 64 to pass through the exposed portion WP of the board W and cut a straight edge surface WE thereon that is parallel with the surface 66*a* of the rip fence 66. Typically, the position of the rip fence 66 is adjusted relative to the saw blade so that at least 1/16 inch of material is removed at any given zone along the exposed portion WP to produce the straight cut edge surface WE. During the cutting operation, the presence of the handles 40 enables the woodworker to stand adjacent the side of the table with his arms overlying the rip fence 66 and slide the fixture 12 on the table 62 with the side wall 18 in engagement with the rip fence 66. This position of the woodworker places him out of the path of a piece of wood that may be thrown rearwardly by the saw blade and enables the fixture with the workpiece therein to be tightly maintained against the fence surface 66*a*, thereby avoiding gouging of the cut edge of the workpiece by the saw blade. The surface of the cut edge of the workpiece thus may be nearly as smooth as that formed by a jointer. The gripping of the handles by both hands of the user also protects the user's hands from the saw.

After the cutting of the edge surface WE has been completed the workpiece W is unclamped and removed from the fixture 12 by turning the knobs 26 in a release direction. The workpiece is then turned 180° and placed in the fixture so that the lower side WS2 confronts the table 62 and the first cut edge WE abuts the side wall 18. The fixture then may be slid along the rip fence 66 in the same manner described above to cut the second straight edge surface (not shown) on the opposite side of the workpiece. The second cut edge surface will be parallel to the first cut edge surface WE. In this way, a workpiece which initially has irregular, unparallel edges can be ripped to provide straight, parallel opposite edges.

Alternatively, after cutting of the edge surface WE, the board need not be repositioned and reclamped in the fixture 10. Instead, the board may be placed directly on the table with the first cut edge surface WE abutting the surface 66*a* of the fence, thereby enabling the workpiece to be provided with a parallel to the surface WE.

If desired, a suitable shim (not shown) having a thickness equal to the thickness of flange 16 may be temporarily placed on the bottom of the exposed portion WP of the board or, alternatively, on the table 62 adjacent the saw blade 64 to compensate for the thickness of the lower flange 16.

Figure 6:
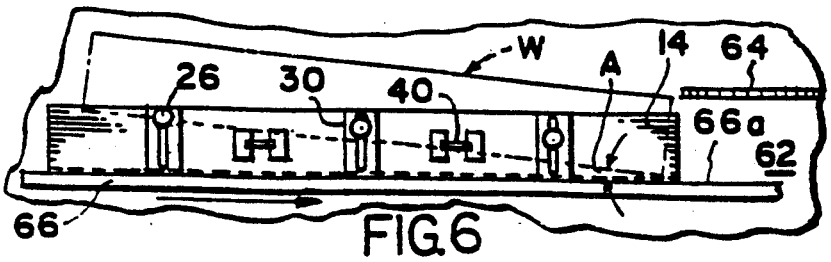
FIG. 6 is a fragmentary plan view of a table saw having the fixture of FIG. i positioned thereon for outting an edge surface that is tapered relative to the fence.

As is shown in FIG. 6, the fixture 10 also can be used to make a tapered cut on the workpiece W by clamping the latter in the channel 20 at a desired angle A to the plane surface 66*a* of the fence 66 and moving the fixture 10 on the table 62 with the side wall 18 abutting the guide fence 66 so as to cause the saw blade 64 to pass through the workpiece. To effect clamping of the workpiece W at the desired angle A in the channel 20, the clamping members 22 may be moved laterally in the slots 29 and clamped against the workpiece at different lateral positions as shown in FIG. 6.

The technique illustrated in FIG. 6 can be used to cut tapers on one or all four sides of the workpiece W by making sequential cuts corresponding to each tapered side to be provided. For example, a first tapered cut can be made as illustrated in FIG. 6. After the first cut, the workpiece is unclamped, rotated 90°, and reclamped to make the second cut. This procedure is repeated a third and fourth time to make four cuts. A tapered leg for furniture can be made in this manner using the fixture 10 in combination with the table saw 60.

Although the fixture 10 has been described above as cooperating with the guide fence 66 present on a conventional table saw 60, the invention is not so limited. The fixture 10 can cooperate with other types of guides, such as a miter gauge slot on a miter table saw. To engage the miter gauge slot, the fixture 10 may include a suitable projection on the lower flange 16 and/or side wall 18 adapted to be received and guided in the gauge slot. The fixture 10 also can cooperate with a suitable guide that may be added on the table.

The embodiment of the invention shown in FIGS. 7–9 is similar in many respects to that shown in FIGS. 1–6 and corresponding parts are identified by corresponding reference characters. In the second embodiment the clamp screws 24 extend through slots 70 formed in housings 71 which are suitably secured to the upper horizontal flange 14. In this instance the slots 70 extend completely through the forward end of the housings 71 so as to enable the screws 24 to move to the extreme ends of the housings 70 as is shown in dash lines in FIG. 8.

Secured to the flange 14 by screws 72 or the like is a shield 73 formed of a suitable, transparent plastic material. That edge of the shield which confronts the housings 71 is provided with notches 74 for the accommodation of the forward ends of the housings. This construction enables the screws 24 to move to the forward edge of the flange 14 without falling out of the slots 70. The length of the shield 73 can be the same as or shorter than the fixture 10, and the width of the shield should be sufficient to enable it to overlie the saw blade and protect the user from chips, sawdust, and the blade itself. Obviously, the height of the shield 73 is greater than the height that the saw blade projects above the surface of the table 62.

The embodiment shown in FIGS. 7–9 also includes a plurality of fence-engageable retainers 74 each of which comprises a base leg 75 received by bolts 76 or the like to the flange 14 and having an upstanding limb 77 terminating in a horizontal tongue 78. Overlying the tongue 78 is one leg 79 of an L-shaped bracket 80 having a second, vertical leg 81 which parallels the wall 18, and terminates at a level above that of the flange 16. The leg 79 has a slot 82 therein in which is slideably accommodated a headed adjusting screw 84 that extends through an opening formed in the tongue 78 and is accommodated in a threaded nut 85. The L-shaped bracket 80 thus is adjustable relative to the fixture 10 so as to enable the bracket leg 81 to move toward and away from the body wall 18 as is shown in chain lines in FIG. 8. In use, the bracket leg 81 may be adjusted to such position that the rip fence 66 is snugly, but slideably, accommodated between the leg 81 and the wall 18 so as to prevent inadvertent movement of the fixture 12 toward the saw blade 64.

Figure 10:
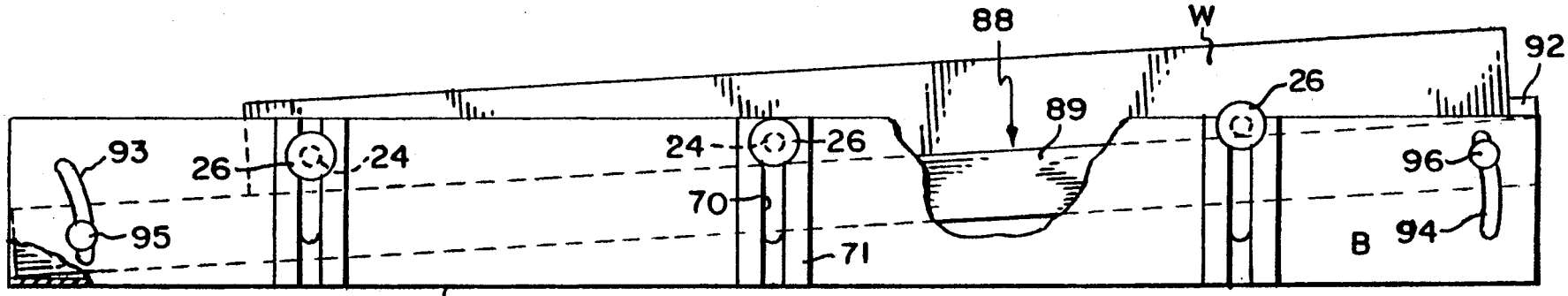
FIG. 10 is a plan view with parts broken away and partly in section of an adaption of either of the two embodiments, parts of the earlier embodiments being omitted for clarity.
Figure 11:
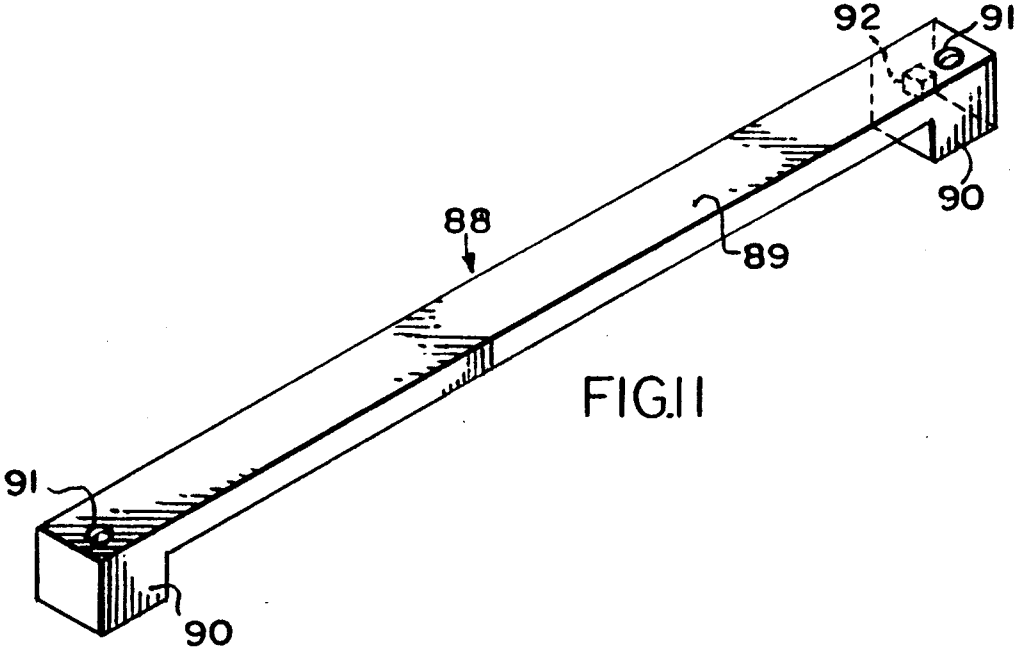
FIG. 11 an isometric view of part of the apparatus shown in FIG. 10.

The embodiment shown in FIGS. 10 and 11 corresponds to either of the two earlier described embodiments, but many of the parts of such other embodiments are omitted from FIG. 10 for the sake of clarity. However, it should be understood that all of the components carried by the fixture 10 of either of the earlier described embodiments may be included in the embodiment shown in FIG. 10.

The invention includes an adjustable guide 88 for use in cutting successive workpieces to provide them with uniform tapering sides. The guide 88 comprises an elongated bar 89 having projections 90 at opposite ends adapted to rest upon the bottom flange 16 of the fixture 10. At opposite ends of the bar 89 are threaded openings 91. One of the extensions 90 carries a laterally projecting lug 92.

In the modified embodiment the upper flange 14 of the fixture 12 is provided with a pair of arcuate slots 93 and 94. The slots may be of equal length, but the slot 93 has one end thereof that is located closer to the side wall 18 than that of the slot 94. A headed locking screw 95 extends through the slot 93 and into the threaded opening 91, and a similar headed screw 96 extends through the slot 94 and into the adjacent opening 91. The clamping screws 24 may be turned so that the pads 36 bear against the workpiece W and, if desired, one or more of the pads may bear directly against the bar 89 to help secure the latter in place. It thus is possible to locate and fix the bar 8 within the fixture 10 so that the longitudinal axis of the bar 89 forms an adjustable angle B with the side wall 18 of the body 12.

In the use of the guide 88 the bar 89 is positioned within the body 12 between the flanges 14 and 16. The bar is adjusted as is permitted by the slots 93 and 94 until the angle B corresponds to the desired angle. The locking screws 95 and 96 then may be turned down to hold the bar in the desired position. The workpiece W, which preferably has been treated earlier so that its opposite edges are parallel and smooth, is placed against one side of the bar 89 with one end of the workpiece abutting the lug 92. The fixture 10 then may be advanced alongside the rip fence 66 in the manner described earlier so as to enable the saw to cut the workpiece W with a taper from one end thereof to the latter.

The guide 88 is particularly useful in those instances in which a plurality of successive workpieces W are to be formed with the same taper.

The disclosed embodiments are representative of presently preferred forms of the invention, but are intended to be illustrative rather than definitive thereof. The invention is defined in the claims.

I claim:

1. A fixture for holding and presenting an elongated workpiece to a cutting tool comprising: an elongated body having an upper flange, a lower flange parallel to and spaced from the upper flange, and a side wall interconnecting the upper and lower flanges in a manner to define an elongated, workpiece-receiving channel having an open side; a plurality of spaced apart clamping members carried by said upper flange for movements toward and away from the lower flange to clamp and unclamp the workpiece in said channel and for movements laterally of said upper flange; shield means carried by said upper flange and extending beyond said open side of said channel in a direction to overlie said cutting tool, said shield means having notches for the accommodation of portions of said clamping members; and retaining means carried by said body for limiting movement of said fixture in a direction toward said cutting tool, said retaining means having a first part extending transversely of said body in prolongation of said upper flange and a second part extending parallel to said side wall.

2. The fixture of claim 1 wherein the clamping members are spaced apart longitudinally of said body.

3. The fixture of claim 1 including at least one handle mounted on said body.

4. The fixture of claim 3 including a plurality of said handles spaced apart from one another longitudinally of said body.

5. The fixture of claim 1 including a guide bar accommodated in said channel, said guide bar being adjustable relative to said body to form a selected angle with said side wall, means for securing said guide bar at said selected angle, and means carried by said bar for engaging and positioning a workpiece in said channel.

6. The fixture of claim 1 wherein each of said clamping members includes a part that is slideable in a slot formed in said upper flange, each of said slots being open at the open side of said channel.

7. The fixture of claim 6 wherein the means for adjusting said angle comprises at least one slot in said upper flange through which the securing means for said guide bar extends, said slot being of such length as to enable movement of said guide bar transversely of said channel.

8. The fixture of claim 5 wherein the means for securing said guide bar in said channel comprises clamping screws at opposite ends of said body extending through elongated slots in said upper flange into said guide bar.

9. A fixture for holding and presenting an elongated workpiece to a cutting tool comprising: an elongated body having an upper flange, a lower flange parallel to and spaced from the upper flange, and a side wall interconnecting the upper and lower flanges in a manner to define an elongated, workpiece-receiving channel having an open side; a plurality of spaced apart clamping members carried by said upper flange for movements toward and away from the lower flange to clamp and unclamp the workpiece in said channel and for movements laterally of said upper flange; shield means carried by said upper flange and extending beyond said open side of said channel in a direction to overlie said cutting tool, said shield means having notches for the accommodation of portions of said clamping members; a guide bar accommodated in said channel, said guide bar being adjustable relative to said body to form a selected angle with said side wall; means for securing said guide bar at said selected angle; and means carried by said bar for engaging and positioning a workpiece in said channel.

10. A fixture for holding an elongated workpiece relative to a guide that is spaced from and in a selected plane relative to a cutting tool, comprising: an elongated C-shaped body having an upper flange, a lower flange underlying and spaced from the upper flange, and a side wall interconnecting the upper and lower flanges in a manner to define an elongated, workpiece-receiving channel, said side wall of said fixture being engageable with said guide; a plurality of workpiece clamping members on the upper flange for movements toward and away from the channel to clamp and unclamp the workpiece; a shield carried by said body and extending therefrom in a direction to overlie said cutting tool; and retaining means carried by said body and extending therefrom in the opposite direction to snugly but slideably accommodate said guide and retain said body spaced from said cutting tool.

11. The fixture of claim 10 wherein the clamping members are mounted for movement laterally of said channel in directions toward and away from the plane of said guide.

12. The fixture of claim 10 including a plurality of handles spaced apart on the upper flange between the clamping members.

13. The fixture of claim 10 including means for adjusting said retaining means to accommodate guides of different thicknesses.

14. A fixture for holding an elongated workpiece relative to a guide that is oriented in a selected plane relative to a saw blade, comprising: an elongated body having an upper flange, a lower flange underlying and spaced from the upper flange, and a side wall interconnecting the upper and lower flanges in a manner to define an elongated, workpiece-receiving channel, said side wall being engageable with said guide; a plurality of workpiece clamping members mounted on the upper flange for movement toward and away from the lower flange to clamp and unclamp a workpiece accommodated in said channel; a plurality of handles mounted on said upper flange for moving said body relative to said saw blade and saw guide while the side wall is engaged with the guide so as to move a workpiece clamped in the channel relative to said saw blade and provide a cut surface on said workpiece that is substantially parallel to said plane; a shield carried by said body and extending therefrom a distance and in a direction to overlie said cutting tool; and retaining means carried by said body and extending in the opposite direction to accommodate said guide and maintain said body against said guide and spaced from said cutting tool while said shield overlies said cutting tool.

15. The fixture of claim 14 including an elongate guide bar; means for securing said guide bar in said channel at a selected angle to said side wall; and a workpiece engaging lug carried by said bar for engaging and supporting a workpiece at said angle.

16. The fixture of claim 15 including means for adjusting said angle.

* * * * *

UNITED STATES PATENT AND TRADEMARK OFFICE

CERTIFICATE OF CORRECTION

PATENT NO. : 5,176,058

DATED : January 5, 1993

INVENTOR(S) : Norman E. Skelly

It is certified that error appears in the above-identified patent and that said Letters Patent is hereby corrected as shown below:

Column 2, line 59, after "2" insert -- is a --.

Column 3, line 2, change "FIG. i" to -- FIG. 1 --; same line, change "out-" to -- cut- --.

Column 4, line 9, after "1-" insert -- 3 --.

Column 7, line 11, change "8" to -- 89 --; line 63, change "of" to -- according to --.

Column 9, line 8, change "saw" (second occurrence) to -- said --.

Signed and Sealed this

Nineteenth Day of October, 1993

Bruce Lehman

*Attest:*

BRUCE LEHMAN

*Attesting Officer*

*Commissioner of Patents and Trademarks*